United States Patent [19]

Hartlage

[11] Patent Number: 4,657,213

[45] Date of Patent: Apr. 14, 1987

[54] IRON HOLDER

[76] Inventor: Andrew C. Hartlage, 6938 Norlynn Dr., Louisville, Ky. 40228

[21] Appl. No.: 658,682

[22] Filed: Oct. 9, 1984

[51] Int. Cl.[4] ..... D06F 79/02

[52] U.S. Cl. ..... 248/117.7; 248/309.1

[58] Field of Search ..... 248/117.2, 117.3, 117.4, 248/117.5, 117.6, 117.7, 309.1; 38/142, 107, 96; 211/13, 42, 43

[56] References Cited

U.S. PATENT DOCUMENTS

| | | | |
|---|---|---|---|
| 470,050 | 3/1892 | Jewell | 211/42 X |
| 1,658,992 | 2/1928 | Koehler | 248/117.4 |
| 2,866,614 | 12/1958 | Lael | 248/117.7 |
| 2,915,269 | 12/1959 | Fleming | 248/117.7 |
| 3,967,802 | 7/1976 | Lomagno | 248/117.7 X |
| 3,986,649 | 10/1976 | Heimstra | 211/42 X |

*Primary Examiner*—J. Franklin Foss

*Attorney, Agent, or Firm*—Donald L. Cox

[57] ABSTRACT

Disclosed herein is an iron holder which is comprised of a pair of essentially parallel and vertical arm means attached to clamp means for securing the arm means to an ironing board, wherein the arm means are sufficiently spaced apart to receive an iron which is placed on end. In the preferred embodiment the arm means and the clamp means are adjustable so as to accommodate various sizes of irons and various sizes of ironing boards.

3 Claims, 3 Drawing Figures

FIG. 2
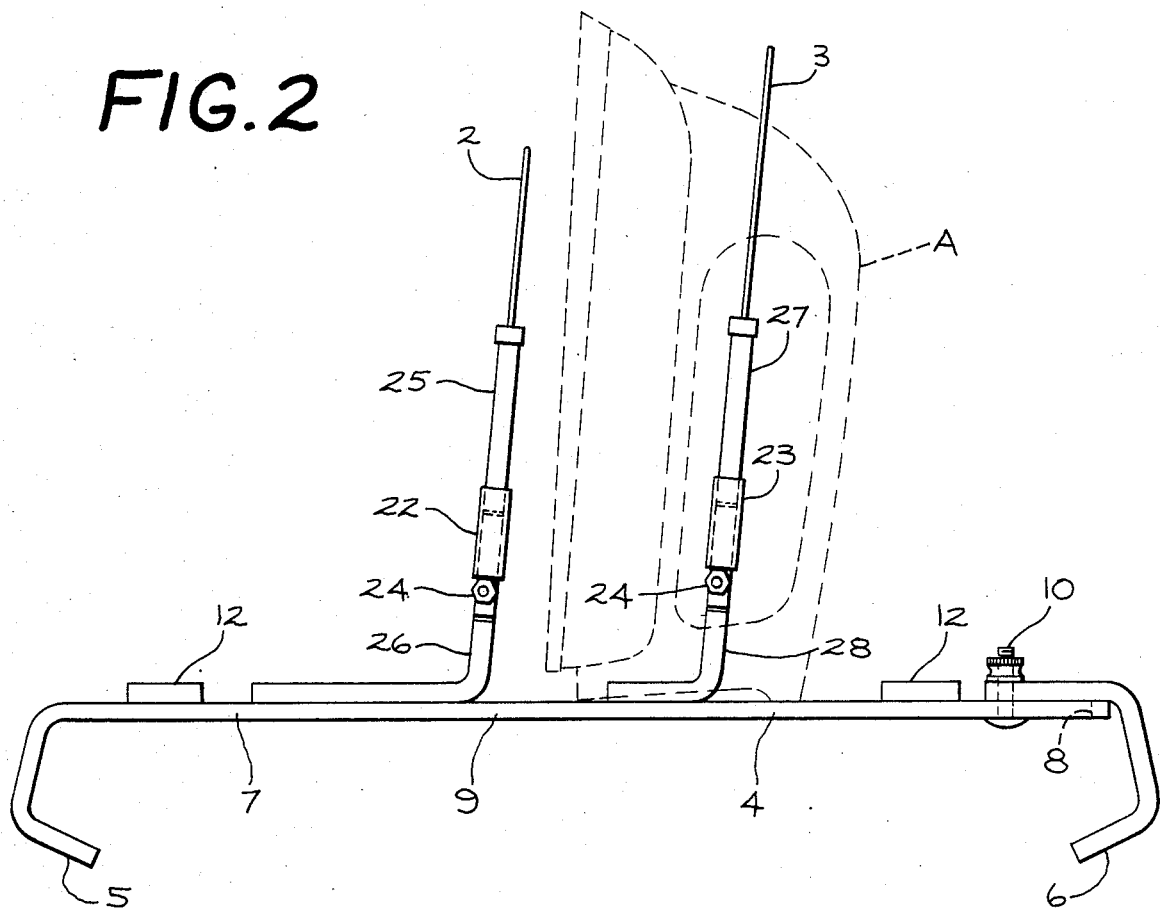
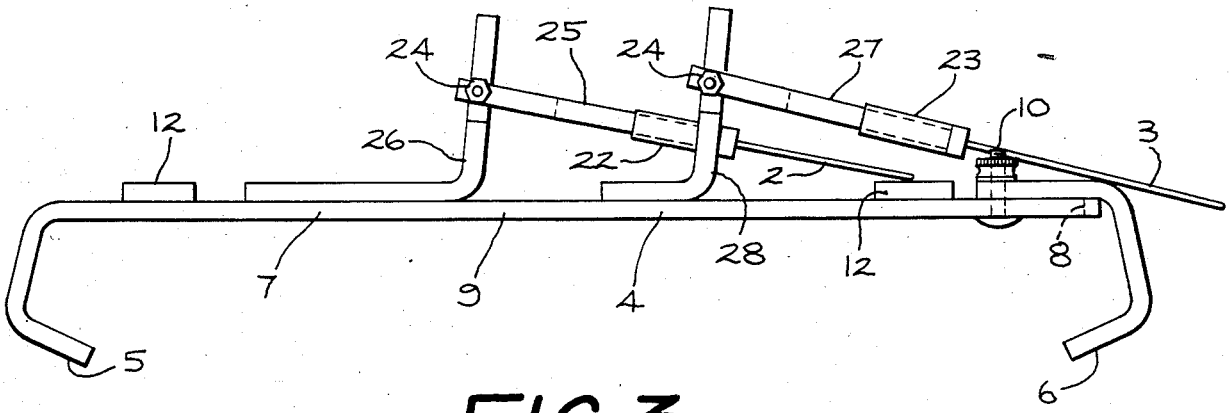
FIG. 3

IRON HOLDER

BACKGROUND OF INVENTION

1. Field of Invention

This invention relates to iron holders. More particularly, this invention relates to iron holders which allow a hand iron to be safely secured in a vertical position on a conventional home or commercial ironing board.

2. Prior Art

Various types of iron holders have been known for many years in the prior art. However, most of the prior art iron holders are of complex construction, are difficult to use, and do not allow the ready placing of an iron into the iron holder when not in use. U.S. Pat. No. 3,951,369, discloses an iron holders which employs a clamp means for securing the holder to the ironing board. U.S. Pat. No. 3,967,802, employs a different type of clamps means for securing the ironing holder to the ironing board.

The U.S. Pat. No. 3,951,369 discloses an iron holder which is generally U-shaped and is formed of a latticework material for dissipation of iron heat. However, the structure of this iron holder is such that the holder is molded to correspond to a particular iron's base shape and it is difficult to use the same holder for various shapes and sizes of irons.

The U.S. Pat. No. 3,967,802 discloses a different type of iron holder which is molded to the approximate shape of the iron bottom. However, this holder design exhibits several design deficiencies. For example, because the iron bottom is fully enclosed, heat dissipation is difficult. Second, the use of irons with varying shaped bottoms is made impossible because the shape of the iron holder itself so closely approximates the shape of the iron bottom.

Accordingly, it is an object of this invention to prepare an iron holder which is universal in character and may be used for securing many types of conventional irons regardless of the shape of the iron bottom.

It is another object of this invention to provide an iron holder which effectively and quickly dissipates iron heat.

It is yet another object of this invention to prepare iron holders which may be folded for convenient storage.

These other objectives are obtained by preparing the device described herein.

SUMMARY OF THE INVENTION

The instant invention involves a vertical iron holder comprised of a pair of essentially parallel and vertical arm means attached to a clamp means for securing the arm means to an ironing board. In the resulting structure, the arm means are sufficiently spaced apart to receive an iron which is placed on end. In order to allow the use of the instant device with various types of irons and in conjunction with various types of ironing boards, in a preferred embodiment, the arm means are vertically adjustable, as are the clamp means.

BRIEF DESCRIPTION OF THE DRAWINGS

FIG. 2 is a side view of the iron holder of the instant invention with an iron secured in place.

FIG. 3 is a side view of the instant iron holder with the arms folded down to facilitate storage.

DETAILED DESCRIPTION OF INVENTION

Figure 1:
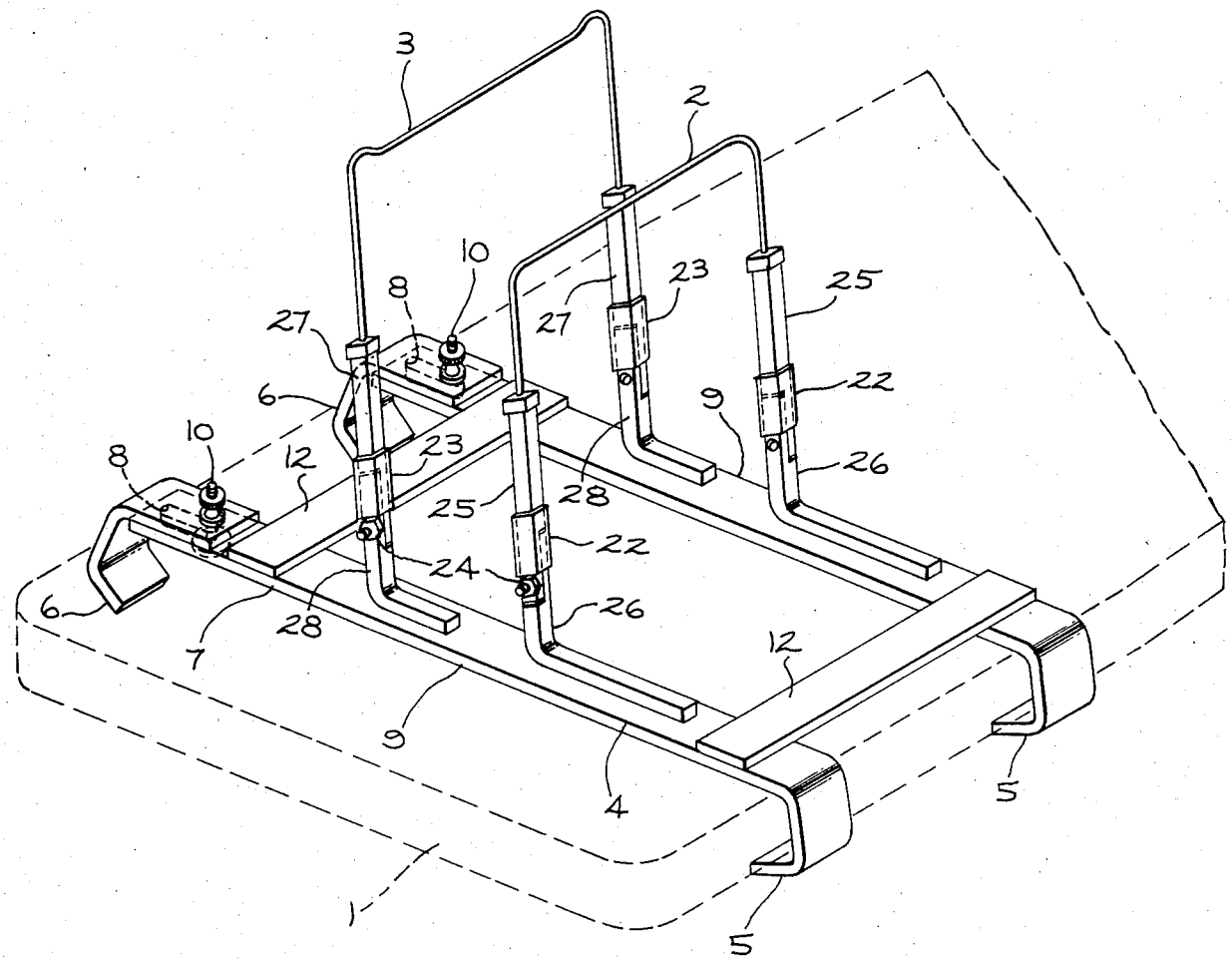
FIG. 1 is a perspective view of the iron holder of the instant invention secured to an ironing board.

The instant invention involves an iron holder which may conveniently hold irons of many varying sizes and shapes. In addition, adjustment means are provided to allow the iron holder of the instant invention to be adjusted so as to receive practically any type of iron which may be used in the home or in commercial ironing establishments. Structure is also provided herein to allow the adjustment of the iron holder clamp means so that it may accommodate virtually any size of ironing board.

The ironing board holder of the instant invention is designed so as to allow the safe holding of conventional clothing irons in a vertical or upright position during periods when there is no need to use the iron. Of paramount importance in the use of an iron holder is safety. Many serious in-home injuries have resulted from irons falling off of ironing boards onto children or adults. These accidents most often have occurred because either there was no iron holder at all or the iron was poorly secured in the iron holder. The iron holder of the instant invention, as pointed out above, finds particular utility because it may receive virtually any size and design of iron and may be used or virtually any size of ironing board.

As shown in FIG. 1, the vertical iron holder of the instant invention is attached to an ironing board (1). In order to hold the iron in vertical position a pair of essentially parallel, vertical arm means (2) and (3) are provided. These arm means are attached to a clamp means (4) for securing the arm means to the ironing board.

It is important in assembling the vertical iron holder of the instant invention that the arm means be sufficiently spaced apart to receive an iron which is placed on end. Generally with conventional home irons, the vertical arms will be spaced about three to four inches apart. By chosing this width, it is possible to accommodate virtually any of the conventional home irons.

The clamp means of the instant invention, as shown in FIG. 1, consists of four C-clamps. Preferably, two of the C-clamps (5) are not adjustable while two of the C-clamps (6) are provided with an adjustment means. The C-clamps are designed so that the C-shape of the clamp is sufficiently wide at a minimum to grab onto the thickness of a conventional ironing board. In other words, the C-clamps should be at least as wide as the ironing board is thick. However, using C-clamps wider than the ironing board will still permit a convenient attachment to the ironing board by using the adjustment clamps.

The adjustable C-clamp (6) may be rendered adjustable by any convenient mechanism. The purpose of the adjustment clamps is to accommodate ironing boards of varying widths. In general, the preferred approach is to attach a moveable C-shaped clamp to the bed (7) of the clamp means (4) and provide a elongated opening (8) in the clamp body so that a screw means (10) or other attachment means when opened will allow free movement of the clamp along the elongated opening so as to increase or decrease the width of ironing boards which may be accommodated. When this screw means (10) is loosened the C-clamp (6) may be moved along the opening (8) to increase or decrease the width of the clamp means.

The bed (7) of the clamp means may be of any convenient design. In the preferred instance, the bed is formed of parallel bars (9) which are arranged perpendicular to the long direction of the ironing board. These bars are secured to place by means of perpendicular support bars (12) which are attachd to the parallel bars by means of screws, nuts, bolts, glue etc. The vertical arm means are attached to the bed using similar devices.

In the preferred embodiment, the vertical arm means are generally U or squared U in shape and are attached to the clamp means in the inverted position. Most preferably the vertical arm means are joined at the top with a vertical bar (13) which is preferably parallel to the bed axis as shown in FIG. 1 and in FIG. 2.

In FIG. 2 the iron A is shown held in place by the vertical arm means (2) and (3). Also shown are sleeves (22) and (23) which are slideably secured over the arm means. The sleeves are free to slide upwardly but are stopped from sliding in a downward fashion by bolts (24). In FIG. 2 each vertical arm is provided with an upper and lower arm (25) and (26) for arm mean (2) and (27) and (28) for arm means (3). When the sleeves (22) and (23) are moved upwardly and on to the upper arms, this will permit the arm means to rotate about the screw (not shown) and bolt at (24) so that the arms may be placed in a "down" position for storage as shown in FIG. 3.

Many changes may be made in this invention without departing from its scope or spirit.

What is claimed is:

1. A vertical iron holder comprising a pair of essentially parallel, foldable, open and vertical arm means attached to a clamp means for securing the arm means to an ironing board wherein said arm means are sufficiently spaced apart to receive and hold in a vertical position an iron which is placed on end, wherein each vertical arm means is comprised of a pair of parallel bars joined at the top with a horizontal bar and wherein said clamp means is adjustable so as to permit attachment to ironing boards of varying widths and said clamp means comprises a bed for attachment to the arm means having a plurality of securing clamps for attaching the bed to the sides of an ironing board.

2. The iron holder of claim 1 wherein each arm means is in the shape of an inverted U.

3. The iron folder of claim 1 wherein each arm means is in the shape of an inverted square U.

* * * * *